United States Patent [19]

Davis

[11] Patent Number: 4,501,101

[45] Date of Patent: Feb. 26, 1985

[54] FIRE RATED COMPONENT WALL SYSTEM

[75] Inventor: Alan H. Davis, Vernon, Tex.

[73] Assignee: Combined America Industries, Inc., Dallas, Tex.

[21] Appl. No.: 439,315

[22] Filed: Nov. 4, 1982

[51] Int. Cl.[3] ..... E04B 1/74

[52] U.S. Cl. ..... 52/404; 52/268; 52/588

[58] Field of Search ..... 52/404, 268, 267, 408, 52/409, 479, 588, 542, 528, 531, 106, 529, 536; 109/78, 49.5

[56] References Cited

U.S. PATENT DOCUMENTS

| | | | |
|---|---|---|---|
| 787,065 | 4/1905 | White | 109/24 |
| 1,844,823 | 2/1932 | Rosenberg | 52/528 X |
| 2,284,229 | 5/1942 | Palmer | 52/588 X |
| 2,739,677 | 3/1956 | Greulich | 52/404 X |
| 3,031,044 | 4/1962 | Stitt et al. | 52/479 X |
| 3,062,337 | 11/1962 | Zittle | 52/404 |
| 3,315,429 | 4/1967 | Swanson | 52/588 |
| 3,608,260 | 9/1971 | Eckel et al. | 52/588 X |
| 3,678,642 | 7/1972 | Scott | 52/588 |
| 4,107,891 | 8/1978 | Cotton et al. | 52/404 X |

OTHER PUBLICATIONS

Blueprint Drawing Without Title or Date.

*Primary Examiner*—Carl D. Friedman
*Assistant Examiner*—Naoko Slack
*Attorney, Agent, or Firm*—Richards, Harris, Medlock & Andrews

[57] ABSTRACT

A fire rated component wall system includes first and second compartmentalized units joined by top and bottom steel cover plates. The first and second units are constructed from interlocking steel panels with sheets of fire retardant material defining a compartment therebetween. The first and second units are mated along the sides formed from the fire retardant material to provide a structural wall system with exterior steel panels and interior layers of fire retardant material. The steel panels are interlocked by an insert member from the end of one panel received and held within a slot of a second panel. An interior weld may be applied to the inside of the interlocking panels of the first and second units to provide a tamperproof connection between the steel panels.

9 Claims, 10 Drawing Figures

FIG. 7
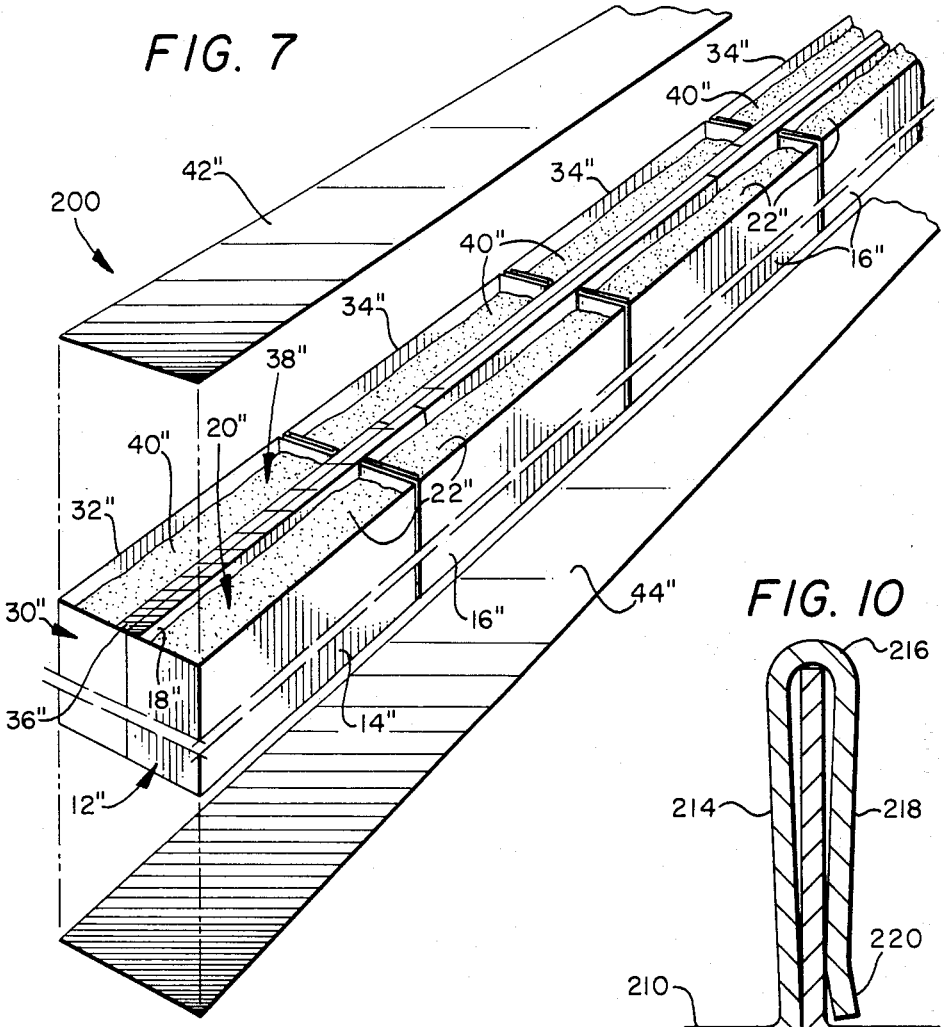
FIG. 10
FIG. 8
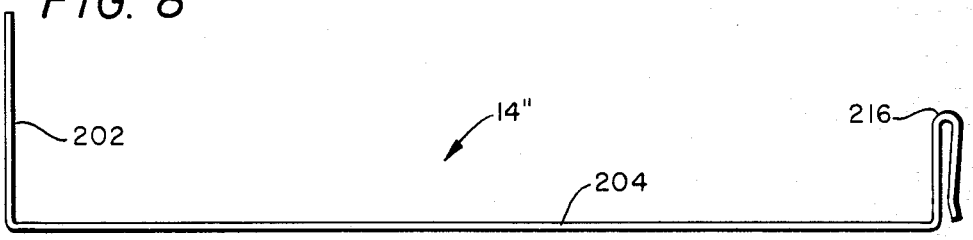
FIG. 9
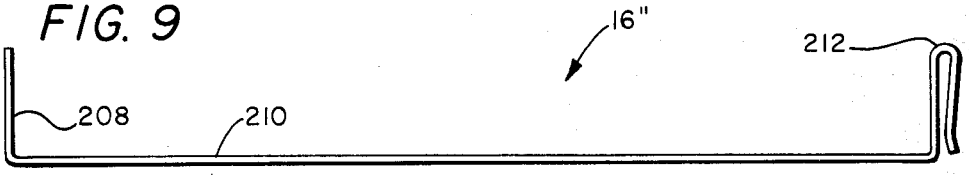

FIRE RATED COMPONENT WALL SYSTEM

TECHNICAL FIELD

This invention pertains to a component wall system for building fire rated, thermal, soundproof or bulletproof walls for a structure, and more particularly to such a system for assembling wall units from interlocking steel panels and sheets of fire retardant material to define compartments therebetween for being filled with thermal, soundproof and/or bulletproof material.

BACKGROUND OF THE INVENTION

Detention and correction facilities house inmates confined to these facilities by our penal system. Existing correction and detention facilities were constructed before the present building codes which require fire rated buildings. Many local, state and federal correctional detention facilities must now meet rigorous building codes requiring the facility to meet certain fire ratings, such as one or two hour fire rated walls. (ASTM Std. E-119 and UBC std. 43-1). New structural systems are required to build fire rated correction and detention facilities to satisfy these building codes.

One system for constructing fire rated walls, floors and ceiling for correctional institutions is a poured in place concrete center section, some of which are covered by steel plates attached to the outside of the concrete core. Such a construction system is cumbersome to construct and does not feature the advantages of steel construction, which are durability, impermeability, ease of cleaning and total preclusion of odors. The metal connectors fastening the steel plates to the concrete core are exposed to the inmates, thereby creating a security risk.

The fire rated structural system of the present invention provides for the construction of a secure facility with fire rated walls to meet present building codes and weighs approximately one-third of poured in place concrete.

SUMMARY OF THE INVENTION

In accordance with the present invention, prefabricated, interlocking steel panels and sheets of fire retardant material are the components of a structural system for assembling fire rated units to be used as walls, ceilings, and floors. Interior panels are formed from sheets of steel having an angle insert member at one end of the major surface of the panel, a generally U-shaped slot proximate the opposite end of the major surface, and a rib extending normally from the major surface at the opposite end of the panel. The interior panels are joined by inserting or sliding the angled insert member from a first panel into the slot of the second panel. The panel section between the slot and the rib is recessed a predetermined distance to allow the overlapping panels to be interlocked with a flush, planar front surface. The insert member is slightly wider than the opening of the slot to cause the side of the groove to frictionally engage the insert member and lock adjoining panels together. The slot is normal to the plane of the major surface so that the angled insert member is straightened under tension to further strengthen the interlocking mechanism. In addition, the insert member may be welded in place in the slot from the back side or interior side of the unit to increase the security or tamper-proofing of the interlocked panels and to improve the aesthetic quality of the wall by eliminating unsightly welds on the front of the wall.

End panels have a side section formed at a right angle to the major surface to form an extension or outside panel at the ends of the section. One end panel has a slot for receiving the insert members of an interior panel and an extended rib member to form the end of the panel. The other end panel has an angled insert member on the end opposite its side panel end to be inserted into the slot of the adjoining interior panel.

One or more layers of fire retardant material, such as sheets of plasterboard, e.g., Sheetrock, are placed along the interior side of the panels and supported on or fastened to the projecting rib extending from the panels to define a compartment therebetween. A second unit is constructed in a similar manner and the opposing fire retardant surfaces are mated to form a section consisting of a first unit and a second unit. The sheets of fire retardant material are aligned so that there are no overlapping edges to allow the fire to penetrate between these spaces in the units. An insulating material may be blown into the compartments between the panel and sheet of fire retardant material.

The unit is completed by the addition of top and bottom steel cover plates, which may be fastened or welded to the adjoining first and second units. Of course, wall, ceiling or floor units may be constructed in the manner described above.

In accordance with another aspect of the present invention, a structural system may be constructed utilizing only a single unit formed from interlocking panel members and an opposite wall formed by sheets of fire retardant material, such as plasterboard Sheetrock. Such a structural component system may be utilized in areas of a correction or detention facility where security requirements are not as rigorous, such as in the administrative portions of the facility.

In accordance with yet another aspect of the present invention, interior panel units may be formed from a single sheet of steel having an insert member at one end normal to the front, major surface and a spring tensioned slot at the opposite end. The slot is dimensioned to receive the insert member such that the front surfaces of adjoining panels are essentially flush.

BRIEF DESCRIPTION OF THE DRAWINGS

For a more complete understanding of the present invention and further objects and advantages thereof, reference is now made to the following Detailed Description taken in conjunction with the accompanying drawings, in which:

FIG. 7 is an alternate embodiment of a fire rated double wall structure of the present invention;

FIG. 8 is a plan view of an end panel of the wall component system illustrated in FIG. 7;

FIG. 9 is a plan view of an interior panel of the wall component system of FIG. 7; and FIG. 10 is an enlarged cross-sectional view of the interconnection between interlocking panels of the wall component system of FIG. 7.

DETAILED DESCRIPTION

Figure 1:
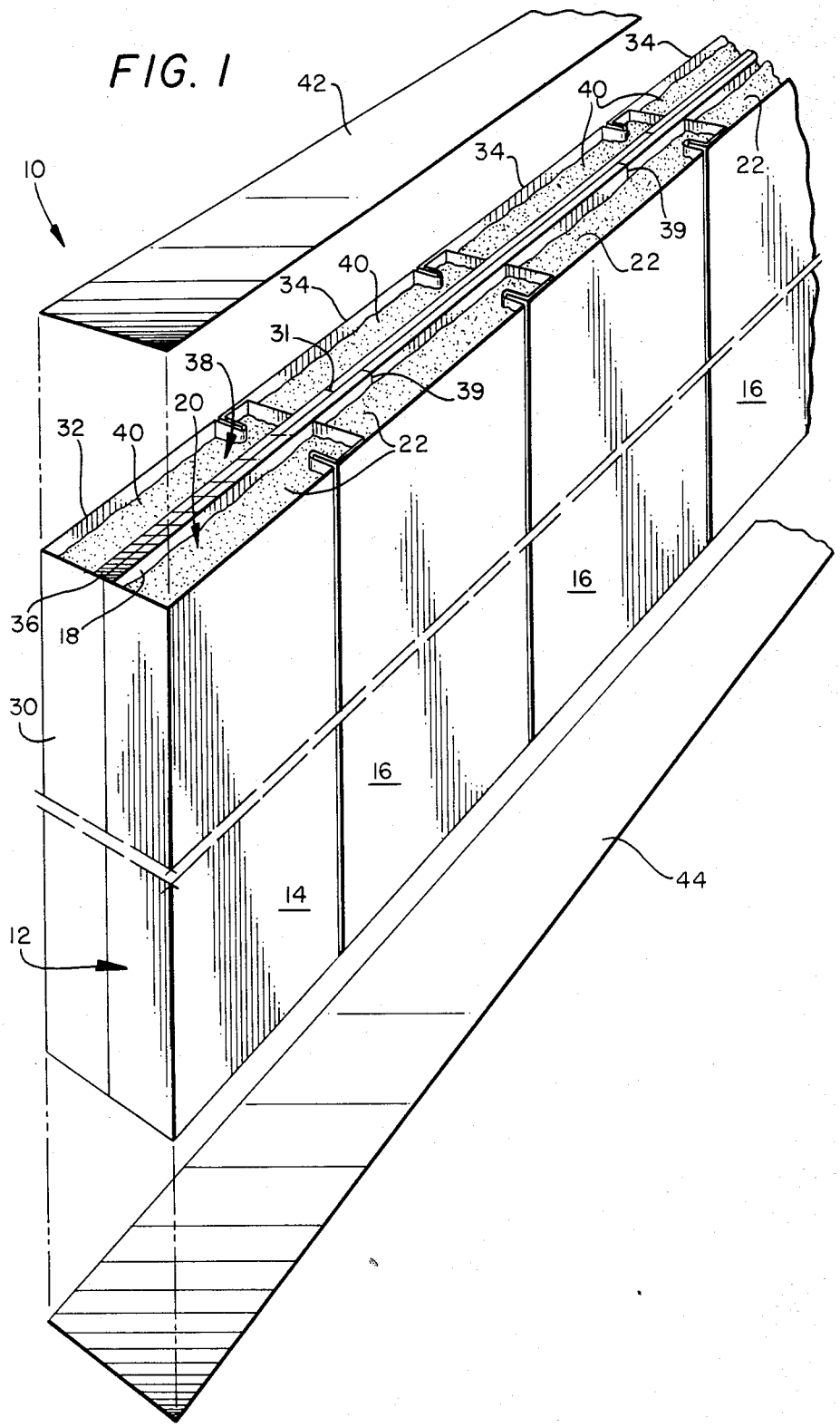
FIG. 1 is a partially exploded perspective view of a fire rated double wall structure of the present invention.

FIG. 1 illustrates a structural unit of the present invention, generally identified by the reference numeral 10. The unit illustrated is described as a wall section. A first wall unit 12 is formed from interlocking steel end panels 14 and interior panels 16. A second end panel 14 (not illustrated) is similar to the first end panel 14, but it has an insert member to lock into the adjoining interior panel 16. Fire retardant sheets 18 extend along the interior or back side of the steel panels 14 and 16 and form a compartment 20 therebetween. An insulating or bulletproof material 22 fills the compartment 20 in the first wall unit 12. The material 22 may be for either sound or thermal insulation or to prevent a bullet from passing through a wall unit 12.

A second wall unit 30 includes an end panel 32 and interlocking interior panels 34 and a plurality of fire retardant sheets 36, such as Sheetrock. As in the first wall unit 12, a second end panel 32 (not illustrated) completes the wall and differs from the end panel 32 illustrated only in the use of an insert member instead of a groove to interlock with an adjoining interior panel. A compartment 38 is formed by the end panels 32 and interior panels 34 and the fire retardant sheets 36 and is filled with an insulating material 40, such as a sound or thermal insulation material.

The second wall unit 30 is mated to the first wall unit 12. The sheets of fire retardant materials 18 and 36 are positioned so that the edges 39 and 31 between opposed sheets are not aligned. The overlapping of the mated sheets of material 18 and 36 eliminates the formation of a channel or space which could allow fire to pass more readily through the units 12 and 30. Additional layers of fire retardant sheets 18 and 36 may be added to increase the fire rating of the structural unit 10.

A steel cover plate 42 and bottom cover plate 44 are attached to first wall unit 12 and second wall unit 30 by any suitable means, such as spot welding. The cover plate 42 and bottom plate 44 anchor the first wall unit 12 and second wall unit 30 together, as well as provide a seal for compartments 20 and 38 holding the insulating or bulletproof material 22 and 40.

Figure 2:
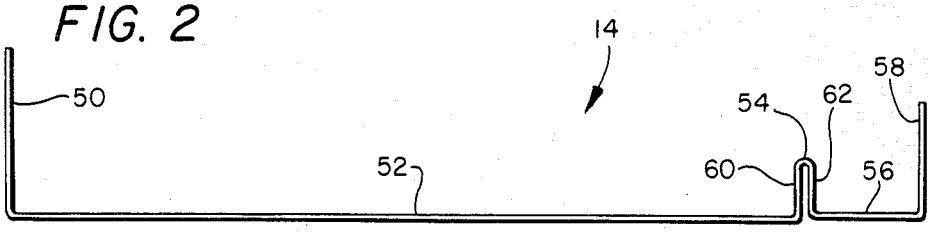
FIG. 2 is a plan view of an end panel of the wall component system of FIG. 1.

Referring now to FIG. 2, the end panel 14 is illustrated in further detail. Of course, the end panel 14 is understood to be similar to end panel 32. The end panel 14 includes an end section 50 normal to a first panel 52, a generally U-shaped slot 54, a second panel member 56 recessed from the plane of panel 52 and a wall support rib 58 normal to the panel member 56. The U-shaped slot 54 has a first elongated arm 60 normal to the panel member 52 and a second elongated member 62 normal to the second panel member 56. The second elongated member 62 is shorter than the first elongated arm 60 to provide a means for recessing the second panel member 56 from the surface of the first panel member 52. The distance the second panel member 56 is recessed is the thickness of the overlapping section of the adjoining interior panel such that interlocked panels are flush with their first panels 52 in a plane. (See FIGS. 4 and 5.) The end section 50 extends a predetermined distance beyond the end of the support section 58 determined by the thickness of the sheet of fire retardant material 18 covered by end section 50 (FIG. 1).

Figure 3:
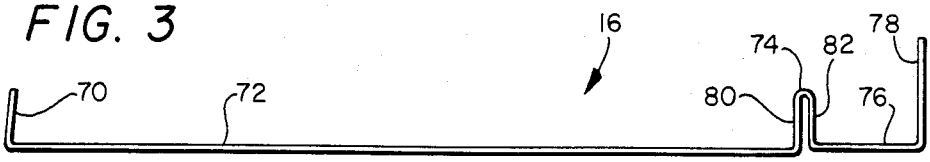
FIG. 3 is a plan view of an interior panel of the wall component system of FIG. 1.

Referring now to FIG. 3, an interior panel 16 is illustrated. Of course, the description of the interior panel 16 is understood to apply to the interior panel 34 of the second wall unit 30. An insert member 70 is bent at a slight angle (approximately 1°) from a line normal to the front panel section 72 of the interior panel 16. The front panel section 72 extends to a generally U-shaped slot 74 of a length slightly greater than that of the insert slot 70. The U-shaped member 74 extends to a recessed second front panel section 76 which extends to a wall support 78 normal to the front panel section 76. The U-shaped slot 74 has a first elongated member 80 extending normally from front panel section 72 and a second shorter elongated member 82. The shortened elongated member 82 allows for the recessed panel section 76 to be recessed a predetermined distance to allow an overlapping panel 14 or 16 to fit flush with the front panel section 72 when insert member 70 is inserted into the U-shaped slot 74.

Figure 4:
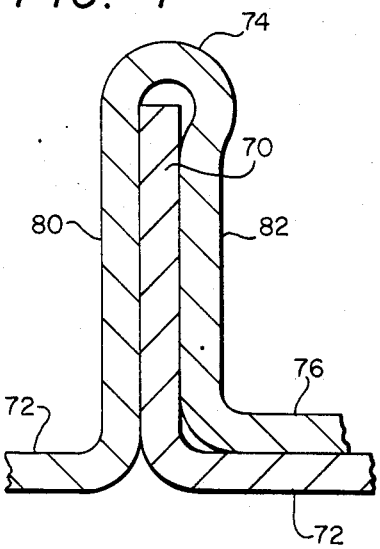
FIG. 4 is an enlarged cross-sectional view of the connection between interlocking panels.
Figure 5:
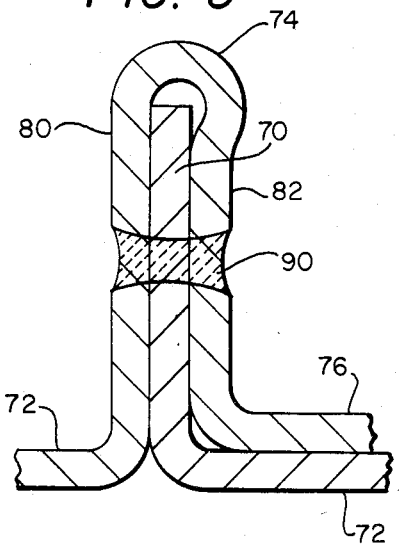
FIG. 5 is an enlarged view of a welded connection between interlocking panels.

Referring now to FIGS. 4 and 5, an enlarged view is shown of a connection between a U-shaped slot 74 end panel and an insert member 70 from a second interlocking panel. Of course, the same connection is provided between an end panel 14 and an interior panel 16. The insert member 70 is wider than the normal opening of the U-shaped slot 74. Insert member 70 is of a width to force the slot 74 to open and to cause the interior sides of the U-shaped slot 74 to frictionally engage the exterior sides of the insert member 70 to lock the adjoining interior panels 16 together. In addition, the tension from inserting the angled insert member 70 into the straight channel of U-shaped slot 74 locks the panels together. FIG. 5 illustrates a weld 90 between the insert member 70 and U-shaped slot 74 to provide a weld 90 which is tamperproof from the front of the assembled first wall section 12. Weld 90 may be used to secure the interlocking of adjoining interior panels 16 and end panels 14 for security requirements in correction and detention facilities. The front panel section 72 of one panel 16 is aligned flush in the same plane with the front panel section 72 of an adjoining panel 14 or 16.

Figure 6:
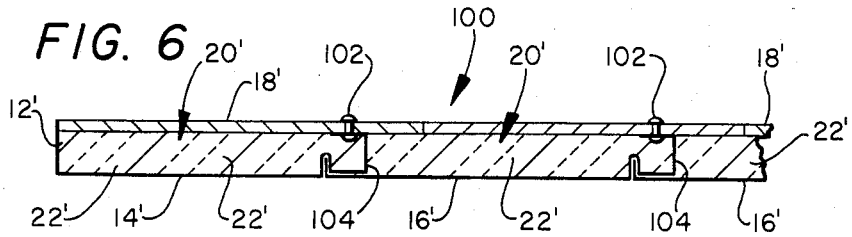
FIG. 6 is a plan view of a fire rated single wall structure of the present invention.

Referring now to FIG. 6, a single unit wall component system 100 is illustrated and comprises an alternative embodiment of the invention as illustrated in FIG. 1. Many of the component parts of the wall component system 100 are substantially identical in construction and function to component parts of the component wall system 10. Such identical component parts are designated in FIG. 6 with the same reference numerals utilized hereinbefore in the description of the wall component system 10, but are differentiated therefrom by means of a prime (') designation.

A first steel end panel 14' is connected to adjoining and interlocking interior panels 16' to form a first wall unit 12'. Sheets of fire retardant material 18' are attached by means of fasteners 102 to an L-shaped arm 104 extending from panels 14' and 16'. A compartment 20' is defined space between the panels 14' and 16' and the sheets of fire retardant material 18'. The compartments 20' may be filled with a suitable sound, thermal insulating, or bulletproof material 22'.

Referring now to FIGS. 7–10, a wall component system 200 is illustrated and comprises an alternate embodiment of the invention as illustrated in FIGS. 1 and 6. Many component parts of the wall component system 200 are substantially identical in construction and function to component parts of the wall component systems 10 and 100. Such identical component parts are designated in FIGS. 7–10 with the same reference numerals utilized hereinabove in the description of the wall component systems 10 and 100, but are differentiated therefrom by means of a double prime (") designation.

A first wall unit 12" is constructed from steel end plates 14" and adjoining interlocking interior panels 16". Sheets of fire retardant material 18" are attached to the opposite side of the panels 14" and 16" to define a compartment 20" therebetween. The compartments 20" may be filled with a suitable sound or thermal insulation or bulletproof material 22".

A second wall unit 30" abuts against the first wall unit 12" and is similar in construction. The second wall unit 30" is constructed from end panels 32" and adjoining and interlocking interior panels 34'. Fire retardant sheets 36", such as plasterboard, are attached to the end panels 32" and interior panels 34" to create compartments 38" therebetween. The compartments 38" may be filled with a suitable sound or thermal insulation or bulletproof material 40". The component wall system 200 may then be joined together by spot welding steel cover sheets 42' and 44" to the top and bottom of the wall units 12" and 30".

Referring now to FIG. 8, an end panel 14" consists of an end panel section 202 extending perpendicular to a front panel section 204. The opposite end of the front panel section 204 extends to a generally U-shaped spring clip 206 used in interlocking end panel 14" with an interior panel 16".

Referring to FIG. 9, interior panel 16" includes an interlocking insert member 208 extending normally from a front panel section 210. The panel section 210 extends to a U-shaped spring clip 212 for receiving and holding insert members 208 of adjoining interior panels 16".

Referring now to FIG. 10, the U-shaped clip 212 includes a first elongated member 214 extending to a curved portion 216 and a second elongated member 218. Elongated member 218 includes a third section 220 near the mouth of the U-shaped clip 212 to facilitate insertion of the adjoining insert member 208. The elongated member 218 is shorter than 214 to allow the adjoining front panels 210 to lie in one plane. The insert member 218 is held by the spring tension between the elongated members 214 and 218.

Although the preferred embodiments of the invention have been illustrated in the accompanying drawings described in the foregoing description, it will be understood that the invention is not limited to the embodiments disclosed, but is capable of numerous rearrangements, modifications and substitutions of parts and elements without departing from the spirit of the invention.

I claim:

1. A fire rated component wall system, comprising:

a first parallelepiped shaped wall unit having one elongated major surface as an outer surface and a second opposite major surface as an inner surface, said outer surface being formed from interlocking steel panels including means for supporting said inner surface a predetermined distance from said outer surface to define a plurality of compartments therebetween, and said inner surface being formed from a layer of fire retardant material;

a second parallelepiped shaped wall unit having one elongated major surface as an outer surface and a second opposite major surface as an inner surface, said outer surface being formed from interlocking steel panels including means for supporting said inner surface a predetermined distance from said outer surface to define a plurality of compartments therebetween, and said inner surface being formed from a layer of fire retardant material;

said interlocking steel panels further including a first end panel having a first front planar panel section extending to an inwardly projecting slot having first and second elongated sides extending inwardly, said second side being a predetermined distance shorter than said first side, a second front panel section parallel to and recessed from said first panel section a predetermined distance as determined by said second side of said slot, a rib projecting inwardly and normally from said second front panel section, and an end panel section extending from the opposite end of said first front panel section, said end panel section extending a predetermined distance beyond said rib as determined by the thickness of said layer of fire retardant material;

at least one interior panel having a first planar front panel section, an insert member forming one end of said panel and projecting inwardly to said inner surface, a generally U-shaped slot at the opposite end of said front panel section, said slot having first and second elongated sides extending inwardly, said second side being a predetermined distance shorter than said first member, a second planar front panel section parallel to and recessed from said first front panel section and recessed a predetermined distance as determined by the length of said second elongated side of said slot, and a rib projecting inwardly and normally from said recessed panel section as the other end of said panel, said rib supporting said interior layer of fire retardant material; and a second end panel having a front planar surface, an end section extending from one end of said end panel and projecting inwardly a predetermined distance beyond the rib supporting member of said interior panel to cover the width of the layer of fire retardant material, the insert member at the opposite end of said front panel section interlocking with an adjoining U-shaped slot of said interior panel section, said first and second end panels and said interior panels are interconnected by inserting said insert members into said U-shaped slots to provide a planar outer surface of said first and second units; and means for joining said first and second wall units along their opposing inner surfaces, whereby said outer surfaces of said first and second units form outer steel surfaces of the fire rated component wall system.

2. The fire rated component wall system of claim 1 and further comprising:

means for adding at least one additional layer of fire retardant material between said layers of fire retardant material of said first unit and said second unit, whereby the fire rating of the component wall system may be increased by said additional layer of the fire retardant material.

3. The fire rated component wall system of claim 1 and further comprising:

a thermal insulating material within the compartments of said first and second units.

4. The fire rated component wall system of claim 1 and further comprising:

a sound insulating material in the compartments of said first and second units.

5. The fire rated component wall system of claim 1 and further comprising:

a bulletproof material in the compartment of said first and second units.

6. The fire rated component wall system of claim 1 and further comprising:

top and bottom steel cover plates spot welded along the top and bottom of the outer surfaces of said first and second units.

7. The fire rated component wall system of claim 1, wherein said sheets of fire retardant materials of said first units overlap the edges of adjoining sheets of fire retardant material of said second unit, whereby the mated inner surfaces of said first and second unit have adjoining sheets of fire retardant material with no passageway between edges of adjoining layers of fire retardant material.

8. The fire rated component wall system of claim 1 and further comprising:

said interlocking steel panels are welded together from the inner side, whereby said panels are joined to reduce tampering with the connection from the exterior side.

9. A fire rated component wall system, comprising:

a parallelepiped shaped wall unit having one elongated major surface as an outer surface and a second opposite major surface as an inner surface, said outer surface being formed from interlocking steel panels including means for supporting said inner surface a predetermined distance from said outer surface to define a plurality of compartments therebetween, and said inner surface being formed from a layer of fire retardant material, said interlocking steel panels further including a first front planar panel section having a selected thickness extending to an inwardly projecting slot having first and second elongated sides extending inwardly, said second side being a predetermined distance shorter than said first side, a second front panel section parallel to and recessed from said first panel section a distance as determined by said second side of said slot for accepting an overlying first front section of an adjacent panel in substantially planar relationship with said first panel section adjoining said second section, a first rib projecting inwardly from said second front panel section, and a second rib projecting inwardly from said first panel section, at least one of said ribs being effective to support said layer of fire resistant material.

* * * * *